United States Patent [19]

Pichler

[11] Patent Number: 4,516,368

[45] Date of Patent: May 14, 1984

[54] ADJUSTABLE STAIRWAY ELEMENT

[76] Inventor: Rudolf Pichler, Schubertweg 10, CH-3073, Gümligen, Switzerland

[21] Appl. No.: 287,737

[22] PCT Filed: Nov. 10, 1980

[86] PCT No.: PCT/CH80/00134

§ 371 Date: Aug. 3, 1981

§ 102(e) Date: Aug. 3, 1981

[87] PCT Pub. No.: WO81/01584

PCT Pub. Date: Jun. 11, 1981

[51] Int. Cl.[3] ..... E04F 11/14; E04F 11/00

[52] U.S. Cl. ..... 52/190; 52/188

[58] Field of Search ..... 52/190, 188, 189, 182

[56] References Cited

U.S. PATENT DOCUMENTS

| | | | |
|---|---|---|---|
| 2,703,005 | 3/1955 | Dobermann | 52/189 |

FOREIGN PATENT DOCUMENTS

| | | | |
|---|---|---|---|
| 962830 | 4/1957 | Fed. Rep. of Germany | 52/190 |
| 1955443 | 5/1971 | Fed. Rep. of Germany | 52/188 |
| 475445 | 8/1969 | Switzerland | 52/182 |
| 13626 | of 1900 | United Kingdom | 52/182 |

*Primary Examiner*—Donald G. Kelly
*Assistant Examiner*—Michael Safavi
*Attorney, Agent, or Firm*—Saul Jecies

[57] ABSTRACT

A construction element having a bridge-like portion of which first and second pillars are provided on the lower part thereof with a plurality of steps. The second pillar being connected by an inclined part to a channel-like portion provided with an outer edge.

1 Claim, 2 Drawing Figures

ADJUSTABLE STAIRWAY ELEMENT

Figure 1:
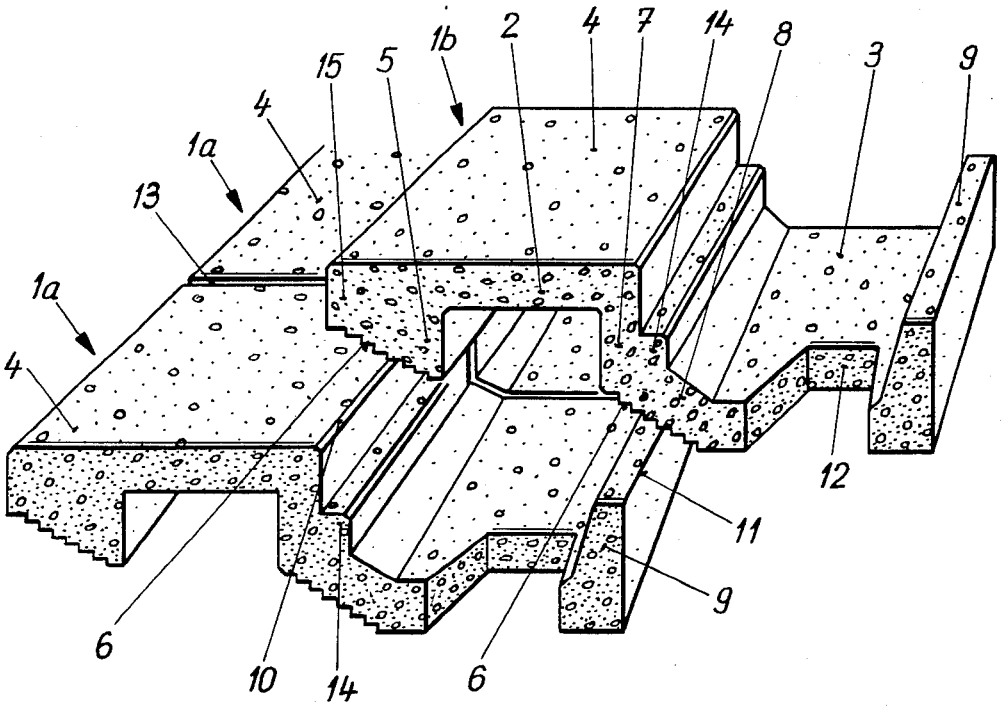

The invention refers to a constructional unit for stairs.

Chiefly in the case of layouts of gardens which are not level and of terrace structures, stairs are required having steps of different heights.

In the Swiss Pat. No. 475 445 a set of constructional units for stairs is disclosed, in which the step height of a flight of stairs can by alteration of the position of a rectangular step unit be adjusted according to two different values. In addition the slope of the stair can also be varied a little by the tread being allowed to project beyond the step unit to a greater or less extent.

The Swiss Pat. No. 485 931 describes a stair having an adjustable slope, in which transversely to the direction of the stair there is provided a toothed moulded concrete part and the tread unit is connected directly or via a corepiece to the set of teeth to be secure against shifting.

The problem underlying the constructional unit for stairs, in accordance with the invention, is to create a standard unit which enables the step height of a flight of stairs to be adjusted here and there by means of sets of teeth to different values up to approximately twice the height, and such standard units may also be laid together in such a way that the step height becomes equal to zero, i.e., that the treads form together a level area which may be provided as a landing.

Figure 2:
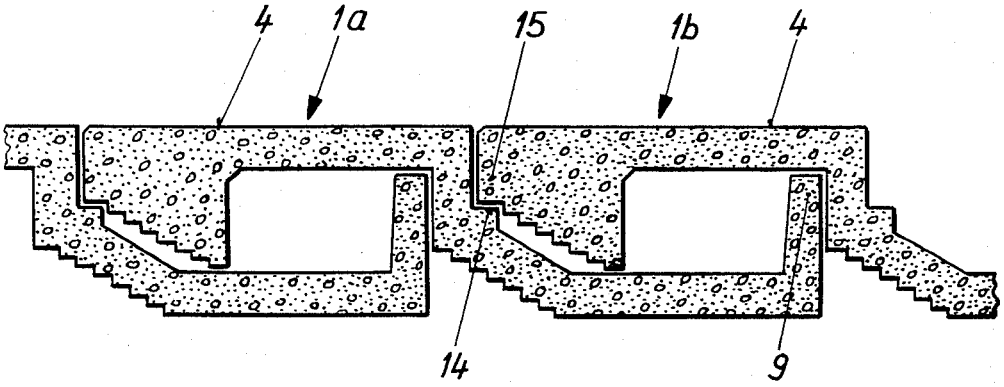

In the drawing an embodiment of the object of the invention is illustrated. There is shown in:

FIG. 1—a portion of a flight of stairs rising from the left, in perspective; and FIG. 2—three constructional units for stairs laid together into a landing.

The constructional unit *1a* for stairs exhibits as a standard unit in cross-section a stirrup-like bridge portion 2 and a connecting trough portion 3. On top the bridge portion 2 is made as a tread the angle at the corners of which amounts to 90°. A first bridge pier 5 of the bridge portion 2 exhibits on the underside of it tooth-like shoulders 6 which are bounded by vertical and horizontal planes. A second bridge pier 7 of the bridge portion 2 is connected at the bottom by an oblique portion 8 to the trough portion 3. The latter is bounded by an outer edge 9 standing upright.

In the case of the portion of a flight of stairs rising from the left as in FIG. 1, for the formation of a medium step height a second constructional unit 1*b* for stairs is laid upon two first constructional units 1*a* for stairs, lying side by side. The first bridge pier 5 of the second constructional unit 1*b* for stairs is seated by one of its shoulders 6 on the rear corner portion 10 of the treads 4 of the first two constructional units 1*a* for stairs. In a corresponding manner the same shoulder 6 of the second bridge pier 7 comes to lie on the region of the outer upper corner 11 of the outer edge 9 of the first constructional units 1*a*.

The shoulders 6 are so directed that the second upper constructional unit 1*b* for stairs cannot be shifted in the descending direction of the flight of stairs. In addition a cutout 12 is provided at the side in the trough portion 3, which serves for correction of the position of the constructional unit for stairs.

The shoulders 6 of the bridge piers 5, 7 enable an optional setting of the step height up to approximately twice its value.

As is shown in FIG. 1, the flight of stairs may be made as wide as you like by laying side by side a number of constructional units for stairs. In that case the lines of separation 13 are advantageously partially covered over by offsetting the constructional units for stairs which are laid on top. It is therefore sufficient to have standard units having only single and double step lengths, which enables economical production.

The lowermost first constructional units for stairs are laid in concrete. Preferably the succeeding ones are installed without fixing.

The second bridge pier 7 exhibits at its mean height a projecting shoulder 14 which is at least twice as big as the bottom shoulders 6. The front lower nose portion 15 of the first bridge pier 5 of the second constructional unit 1*b* for stairs may accordingly be laid on the shoulder 14 and the underside of the tread 4 may be laid on the outer edge 9 of the trough portion 3 of the first constructional unit 1*a* for stairs, so that the top surfaces of the treads 4 of the constructional units 1*a*, 1*b* for stairs come to lie in the same plane and form a landing (FIG. 2).

The constructional unit for stairs enables the production of a flight of stairs having ramps at the side for perambulators, shopping trolleys, etc. This unit may be shut off at the sides between the two bridge piers 5 and 7.

The flight of stairs may be provided with different step heights, the step height at the top being chosen to be the least. The flight of stairs may also, advantageously in the case of terrace houses, be wide at the bottom and narrower towards the top. Hence it may be designed in an individual way. Depending upon the nature of the ground, corrections may be carried out. At required points of the flight of stairs landings may be erected.

If the constructional unit for stairs is provided for the construction of tiered standing and seating, for example, for sports stadia, it is advantageous to employ only the front part of it, omitting the parts 9, 3, 8, 14.

I claim:

1. A constructional unit for stairs, comprising a stirrup-like bridge portion having an upper surface;

said upper surface of said bridge portion being of rectangular shape and having a corner portion located on the rear end of said bridge portion a trough portion, connected to said bridge portion by an oblique portion, having a rectangular outer edge standing upright;

a cutout located at the side of said trough portion;

a front bridge pier on one side of said stirrup-like bridge portion terminating in a nose portion;

said nose portion having an underside formed with tooth-like shoulders;

a second bridge pier, having on the underside thereof tooth-like shoulders on the back side of said stirrup-like bridge portion.

* * * * *

UNITED STATES PATENT AND TRADEMARK OFFICE

CERTIFICATE OF CORRECTION

PATENT NO. : 4,516,368

DATED : May 14, 1985

INVENTOR(S) : Rudolf Pichler

It is certified that error appears in the above-identified patent and that said Letters Patent is hereby corrected as shown below:

On the title page, the issue date for the above Patent should be --May 14, 1985--.

Signed and Sealed this

*Seventeenth* Day of *September 1985*

[SEAL]

*Attest:*

DONALD J. QUIGG

*Attesting Officer*

*Commissioner of Patents and Trademarks—Designate*